United States Patent [19]

Birmingham

[11] 4,085,642

[45] Apr. 25, 1978

[54] BREAD SLICING AND STORAGE CONTAINER

[76] Inventor: Thomas F. Birmingham, Beacon Bldg., Tulsa, Okla. 74103

[21] Appl. No.: 794,250

[22] Filed: May 5, 1977

[51] Int. Cl.[2] ..... B26D 4/50; B26D 7/20

[52] U.S. Cl. ..... 83/764; 83/454

[58] Field of Search ..... 83/454, 455, 761, 762, 83/763, 764

[56] References Cited

U.S. PATENT DOCUMENTS

| | | | |
|---|---|---|---|
| 597,013 | 1/1898 | Miller | 83/761 |
| 2,398,192 | 4/1946 | Scheminger, Jr. | 83/762 |
| 2,916,068 | 12/1959 | Zerneke et al. | 83/762 |
| 3,058,503 | 10/1962 | Perakis | 83/764 |
| 3,971,273 | 7/1976 | Peters et al. | 83/762 X |

*Primary Examiner*—Willie G. Abercrombie

*Attorney, Agent, or Firm*—Head, Johnson & Chafin

[57] ABSTRACT

A novel bread slicing and storage unit having adjustable slicing guide side walls and a movable end plate for firmly holding bread loaves of varying sizes during slicing thereof.

4 Claims, 5 Drawing Figures

BREAD SLICING AND STORAGE CONTAINER

BACKGROUND OF THE INVENTION

1. Field of the Invention

This invention relates to a bread slicing and storage unit particularly designed for home use, having adjustable slicing guides and a movable end plate for accommodating loaves of varying sizes and a cover for using the apparatus as a compact bread storage container when not in use for slicing purposes.

2. Prior Art

Numerous attempts have been made in the past to produce an efficient bread slicing unit. With home baking gaining in popularity, the need for such apparatus naturally increases. Perhaps nothing is quite so frustrating as producing a perfectly baked loaf of bread only to transform it into an unrecognizable mass in an attempt to slice it.

A simple bread cutter is shown in the U.S. Pat. No. 179,934, issued July 18, 1876, to Merwin which discloses a rectangular case having vertical slits in the sides thereof for slicing bread into block forms. Use of the apparatus, however, requires that the loaf be first cut to the size of the rectangular case and transferred thereto for slicing.

The combined bread box, slicer, and knife holder shown in U.S. Pat. No. 1,822,581, granted to Brown and issued Sept. 8, 1931, also uses a plurality of slicing guides but makes no provision to accommodate bread loaves of varying sizes. Similar problems are also encountered with the slicing board shown in U.S. Pat. No. 2,398,192 issued to Scheninger on Apr. 9, 1946.

The apparatus disclosed in U.S. Pat. No. 3,058,503 issued Oct. 16, 1962 to Perakis which was designed primarily for cutting meat does not function properly as a practical matter for slicing soft compressible foodstuffs, such as bread, in thin slices.

It is therefore an object of this invention to disclose a practical efficient bread slicer which will accommodate bread loaves of varying sizes and also serve as a storage container for the loaves.

SUMMARY OF THE INVENTION

The invention contemplates a novel bread slicing apparatus and storage container which will accommodate loaves of varying sizes.

Basically, the invention comprises a base for supporting the loaf to be cut and a fixed end wall secured perpendicularly to the base. Adjustable side walls are provided having knife guide slits therein, said side walls being movable transversely with respect to the base to hold loaves of varying widths. A movable end plate opposite the end wall is also provided to keep the loaf from shifting longitudinally along the base during slicing.

When not in actual use for slicing purposes, a cover which abuts the base and end wall is furnished for bread storage purposes.

DETAILED DESCRIPTION OF THE PREFERRED EMBODIMENT

Figure 1:
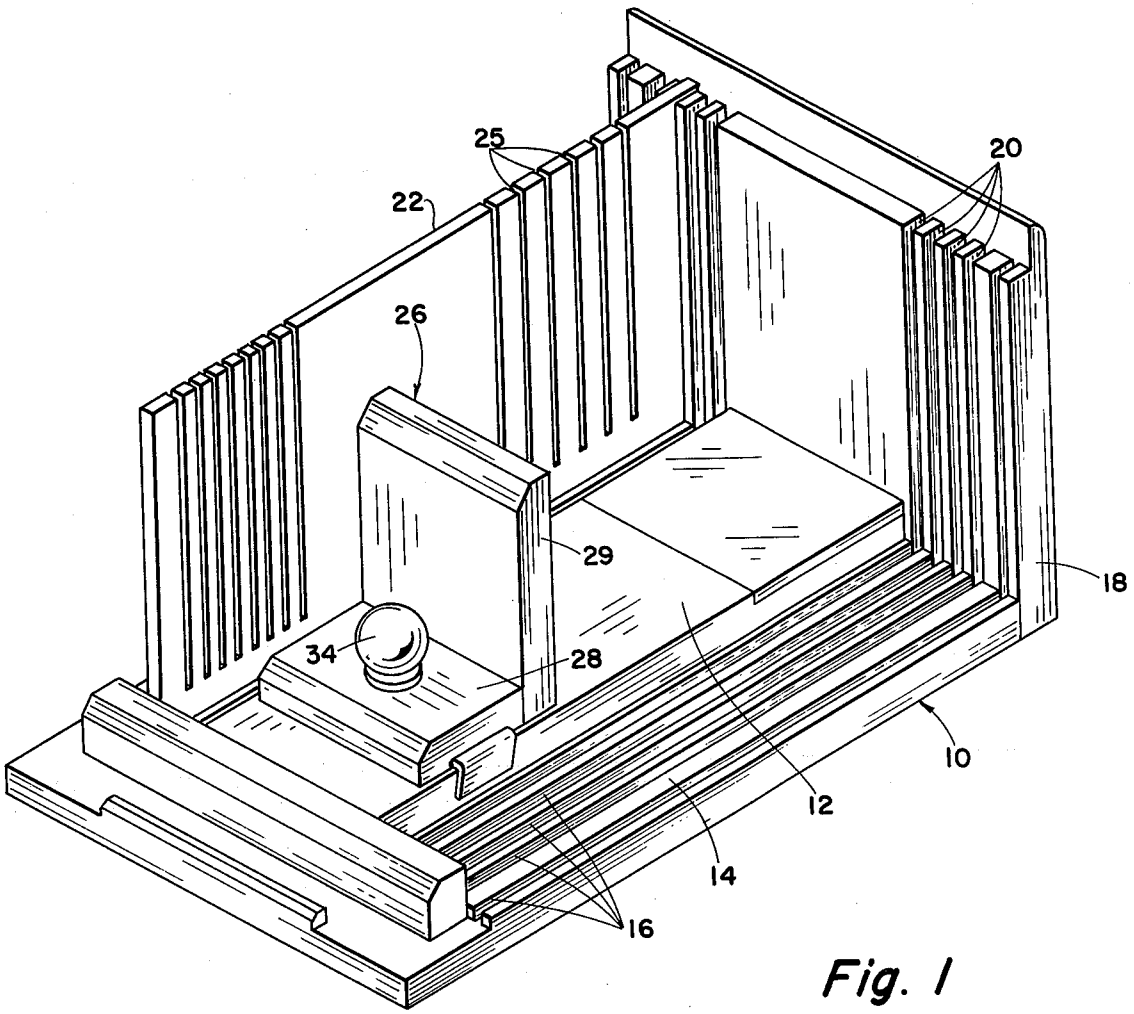
FIG. 1 is a perspective view of the apparatus showing a single slicing guide in place.

Referring now to the drawings and in particular to FIG. 1, there is shown a perspective view of the preferred embodiment of the invention absent the housing cover and one of the sliding guides.

The base, generally indicated by reference character 10, has a centrally located, slightly raised cutting surface 12 upon which the bread loaf is placed in preparation for slicing. The base surfaces 14 adjacent the cutting surface 12 have a plurality of spaced longitudinal grooves 16. An end wall 18 is securely affixed to one end of base 10 in perpendicular juxtaposition therewith. End wall 18 also has a plurality of grooves 20 of the same width as the base grooves 16 and in common alignment therewith. The commonly aligned grooves of the base 10 and end wall 18 are designed to receive slicing guide 22 and slicing guide 24 (not shown in FIG. 1). Slicing guide 22 has a plurality of vertical knife slits 25, which extend from the top of the guide as shown in FIG. 1 to a position slightly below cutting surface 12 when the guides are placed in the grooves of base 10 and end wall 18. The end plate generally indicated by reference numeral 26 is slidably mounted to cutting surface 12 of base 10.

Figure 2:
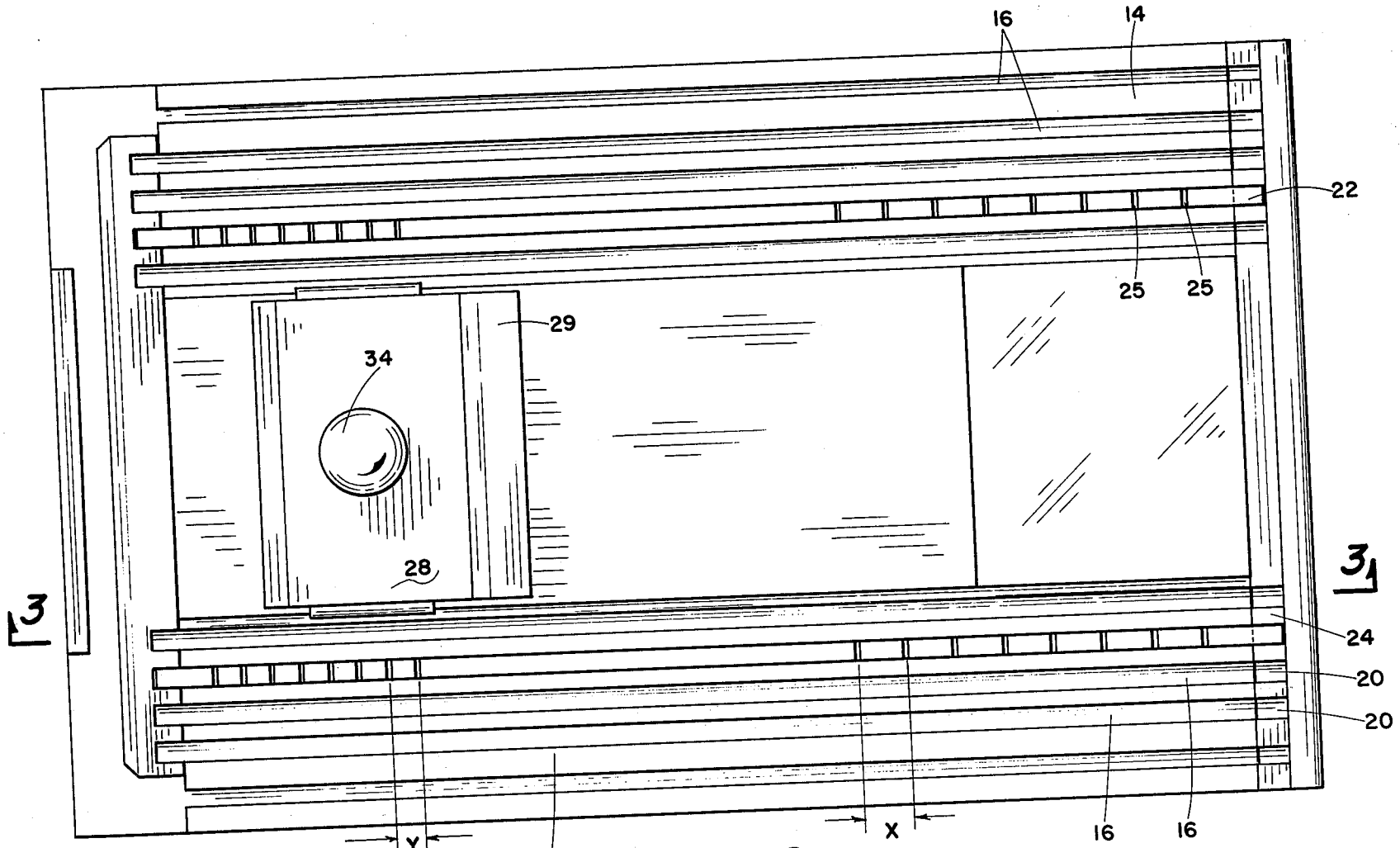
FIG. 2 is an elevational view of the apparatus with the cover removed.

As shown in FIG. 2, the slicing guides 22 and 24 serve the dual purposes of holding both sides of a loaf of bread (not shown) to prevent compression thereof during slicing and guiding the cutting knife edge to produce even slices. The plurality of grooves 16 and 20 in the base 10 and end wall 18, respectively, permit lateral adjustment of the slicing guide positions to accommodate varying widths of bread loaves. Knife slits 25 of slicing guide 24 are aligned with the corresponding knife slits in slicing guide 22. As shown in FIG. 2, the separation distance $x$ between the knife slits on the right-hand side of slicing guide 24 are wider than the separation distance $y$ between the knife slits on the left-hand side of the slicing guide. As the slicing guides may be placed in reverse position, this feature permits a choice of sliced bread thickness by the user.

Figure 3:
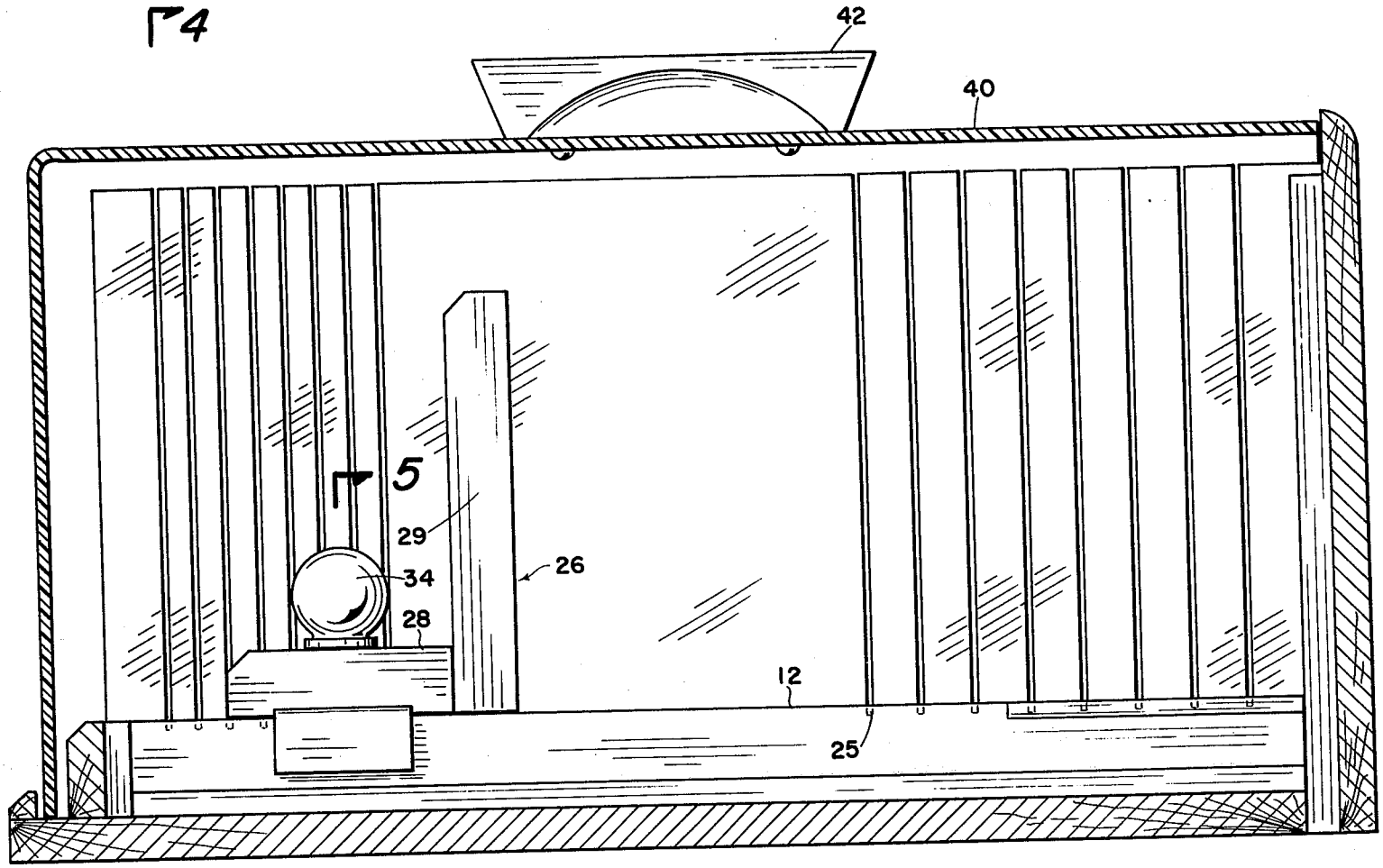
FIG. 3 is a sectional view of the apparatus taken along line 3—3 of FIG. 2.

FIG. 3 is a cross-sectional view along line 3—3 of FIG. 2 and also illustrates the placement of cover 40 in place when the unit is being used as a bread storage container. A handle 42 is shown affixed to the top of cover 40 to facilitate handling and use thereof.

Figure 4:
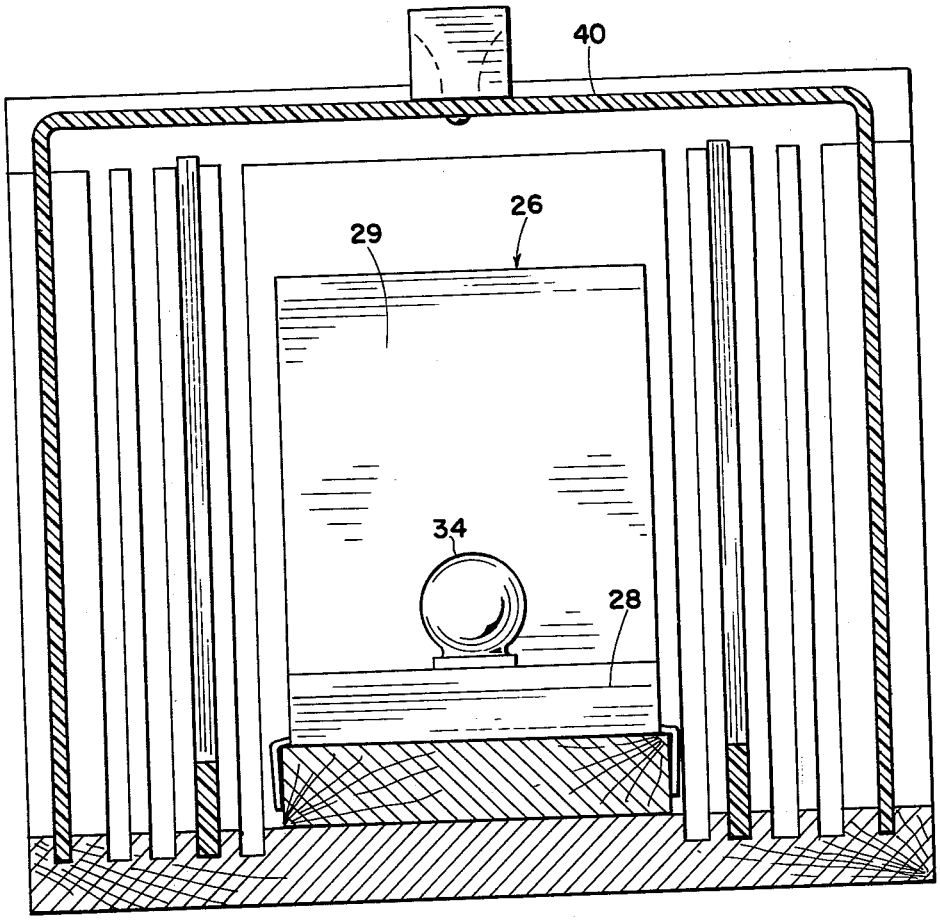
FIG. 4 is a sectional view of the apparatus taken along line AA of FIG. 3.
Figure 5:
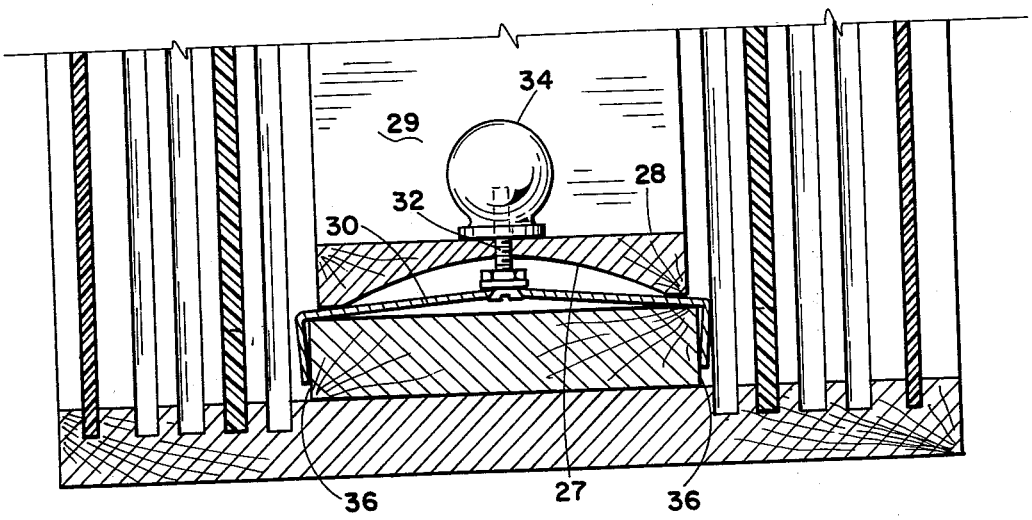
FIG. 5 is a fractional view, partly in cross-section, of the application taken along line BB of FIG. 3.

FIG. 4 is a cross-sectional view along line A—A of FIG. 3 and clearly illustrates end plate 26. A view of the end plate, partly in cross-section, is also shown in FIG. 5. A fastening bar 28 extends generally perpendicular from the end plate butt 29 and parallel to cutting surface 12. The underside 27 of fastening bar 28 is concave in shape to receive clamp 30 under tension, which is positioned between fastening bar 28 and cutting surface 12. A bolt 32 passes through clamp 30 and through a hole drilled in fastening bar 28. Knob 34 is female threaded to receive bolt 32. As shown in FIG. 5, threading knob 34 on bolt 32 places the clamp in tension and causes same to grip the vertical sides 36 of cutting surface 12, thus providing a convenient means of securely but adjustably fastening the end plate at selected points along the distance of the cutting surface to hold the loaf firmly in position between the end wall 18 and the end plate butt 29 for slicing.

Whereas the present invention has been described in particular relation to the drawings attached hereto, it should be understood that other and further modifications apart from those shown or suggested herein may be made within the spirit and scope of this invention.

What is claimed is:

1. An apparatus for slicing bread, which comprises:

a base for supporting the loaf, having a plurality of spaced longitudinal grooves;

an end wall perpendicularly secured to one end of the base, having a plurality of longitudinal grooves aligned with the base grooves;

a first movable side member capable of being positioned in an aligned groove common to the base and end wall, having a plurality of knife guide slits;

a second movable side member capable of being positioned in an aligned groove common to the base end wall, having a plurality of knife guide slits; and an adjustable end plate substantially parallel to the end wall, slidably mounted to the base.

2. Apparatus for slicing bread as recited in claim 1 wherein the base and end wall members are substantially rectangular in shape.

3. Apparatus for slicing bread as recited in claim 1 wherein the side members are reversible in placement and have guide slits separated at different distance to produce varying slice widths.

4. Apparatus for slicing bread as recited in claim 1, further comprising:

a complementary housing for use in conjunction with the base and end wall to form a box-like structure for bread storage.

* * * * *